US007032258B2

(12) United States Patent
O'Hanlon

(10) Patent No.: US 7,032,258 B2
(45) Date of Patent: Apr. 25, 2006

(54) INFLATABLE HOT TUB KIT

(76) Inventor: Patrick O'Hanlon, 218 Main St., Ste 393, Kirkland, WA (US) 98033

( * ) Notice: Subject to any disclaimer, the term of this patent is extended or adjusted under 35 U.S.C. 154(b) by 0 days.

(21) Appl. No.: 11/037,879

(22) Filed: Jan. 18, 2005

(65) Prior Publication Data

US 2005/0155145 A1 Jul. 21, 2005

Related U.S. Application Data

(60) Provisional application No. 60/537,257, filed on Jan. 16, 2004.

(51) Int. Cl.
*A47K 3/00* (2006.01)
*E04H 9/00* (2006.01)

(52) U.S. Cl. ..... 4/487; 4/506; 4/584; 4/588; 441/40

(58) Field of Classification Search ..... 4/487, 4/488, 506, 507, 511, 513, 541.1, 584–586, 4/588, 589, 593; 441/40, 41
See application file for complete search history.

(56) References Cited

U.S. PATENT DOCUMENTS

| | | | | |
|---|---|---|---|---|
| 4,126,905 A | | 11/1978 | Russell et al. | 4/172 |
| 4,135,256 A | | 1/1979 | Limegrover | 4/171 |
| 4,149,281 A | | 4/1979 | Bob et al. | 4/171 |
| 4,535,490 A | | 8/1985 | Wright | 4/585 |
| 4,706,307 A | | 11/1987 | Smith | 4/487 |
| 4,754,502 A | | 7/1988 | Bowen | 4/487 |
| 5,136,962 A | * | 8/1992 | Palmer et al. | 441/40 |
| 5,570,480 A | | 11/1996 | Yeung | 4/487 |
| 5,946,744 A | | 9/1999 | Peterson | 4/506 |
| D451,975 S | | 12/2001 | Gordon | D21/803 |

* cited by examiner

*Primary Examiner*—Tuan Nguyen
(74) *Attorney, Agent, or Firm*—Dean A. Craine

(57) ABSTRACT

An inflatable hot tub kit that includes a self-supporting tub structure that can be used on ground or used in a body of water. The kit includes a thermostat and hoses designed to connect to an external fresh water supply system. The tub structure comprises three inflatable ring sections that form the sidewalls designed to hold warm or hot water. The upper ring section is octagonal-shaped when viewed in plan view. In cross-section, the upper ring section is circular and relatively large so that when the tub structure is placed in a body of water, the water edge is approximately 8 to 10 inches below the top surface of the upper section. The middle ring section is flat in cross-section and vertically aligned under the center axis of the upper ring section. The middle ring section provides buoyancy and supports the upper ring section when used on the ground or extends into the body of water to provide buoyancy. Attached to the middle ring section is an inflatable lower ring section. Attached to the lower ring section is a flat, insulated, flexible floor panel. A suitable air inlet/outlet port and a tub-through drain are also provided.

20 Claims, 5 Drawing Sheets

INFLATABLE HOT TUB KIT

This utility patent application is based on the provisional patent application (Ser. No. 60/537,257) filed on Jan. 16, 2004.

BACKGROUND OF THE INVENTION

1. Field of the Invention

This invention pertains to inflatable hot tubs or pools, and more particularly inflatable hot tubs or pools designed for use both on land or in a body of water.

2. Description of the Related Art

Many recreational vehicle (RV) owners and campers would find a portable, self-supporting hot tub that can be easily transported and temporarily setup and filled with warm or hot water next to their vehicle very desirable.

In many boat moorage areas, the lake or ocean water around a boat may be too dirty or too cold for swimming or soaking. While many boat operators dream of sailing or operating their boats in fresh, warm water in some distant exotic region, most boat operators do not. A floating hot tub that can be easily and quickly assembled in the water adjacent to the boat that can be filled with warm or hot water would be highly desirable.

Storage space on a RV, camper or boat is of course limited. Therefore, a hot tub that stores in a compact configuration and then can be easily and quickly assembled in a small area would be highly desirable. Ideally, such a structure should include a self-supporting tub structure that does not require secondary rigid members. Also, when used in a large body of water with waves, the sidewalls of the tub structure should have sufficient height to prevent water from splashing into and out of the tub structure.

SUMMARY OF THE INVENTION

The above stated objects are met by the hot tub kit disclosed herein that includes an inflatable, cylindrical shaped tub structure with a flat bottom. The sidewall of the main body is made of three stacked, inflatable ring sections that together are sufficient in buoyancy to float and partially support up to four users sitting inside the main center area located therein. During use, the main center area is filled with warm or hot water.

The upper section is octagonal or circular in cross-section similar to an larger inner tube. When the tub structure is placed in a body of water, the buoyancy of the tub is sufficient so that top edge of the upper ring section is located 8 to 10 inches above the water line. The middle ring section is rectangular in cross-section and designed to form a relatively flat, curved sidewall. When used in a body of water, the middle ring section is normally submerged. When the tub structure is used out of the water, the middle ring section provides vertical support. Attached to the lower edge of the middle ring section is an inflatable lower ring section that also provides buoyancy when submerged and provides support when used on the ground. In the preferred embodiment, the lower ring section is circular in cross-section and much smaller in diameter than the upper ring section. Attached to the lower ring section is a flat, non-inflatable, flexible floor panel designed to provide greater floatation and support for the users sitting thereon.

The kit also includes a master control unit that connects to an external electrical system, water supply and water heating system. The master control unit includes a water pump to deliver water to the tub structure, a solenoid check valve used to control the flow of water into the tub structure, and a wireless transmitter that connects to a remote, wireless receiver operated by the user. During use, the solenoid check valve is connected to a water supply line. An optional thermostat is also provided that is coupled to the solenoid check valve in the master control unit to automatically regulate the temperature of the water in the tub structure.

DESCRIPTION OF THE PREFERRED EMBODIMENT(S)

Figure 1:
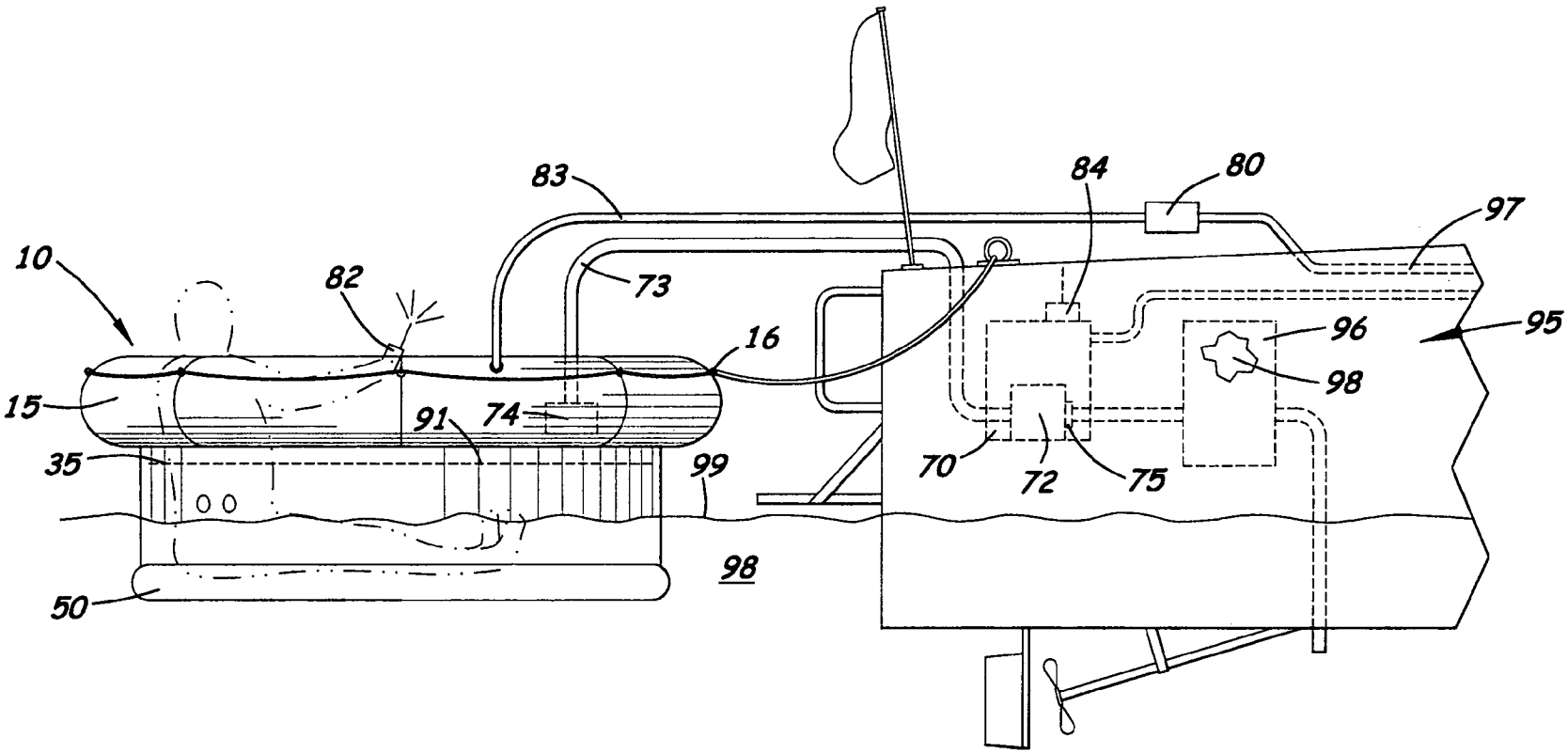
FIG. 1 is a side elevational view of the floating inflatable hot tub located behind a boat and attached to a master control unit located inside the boat.
Figure 2:
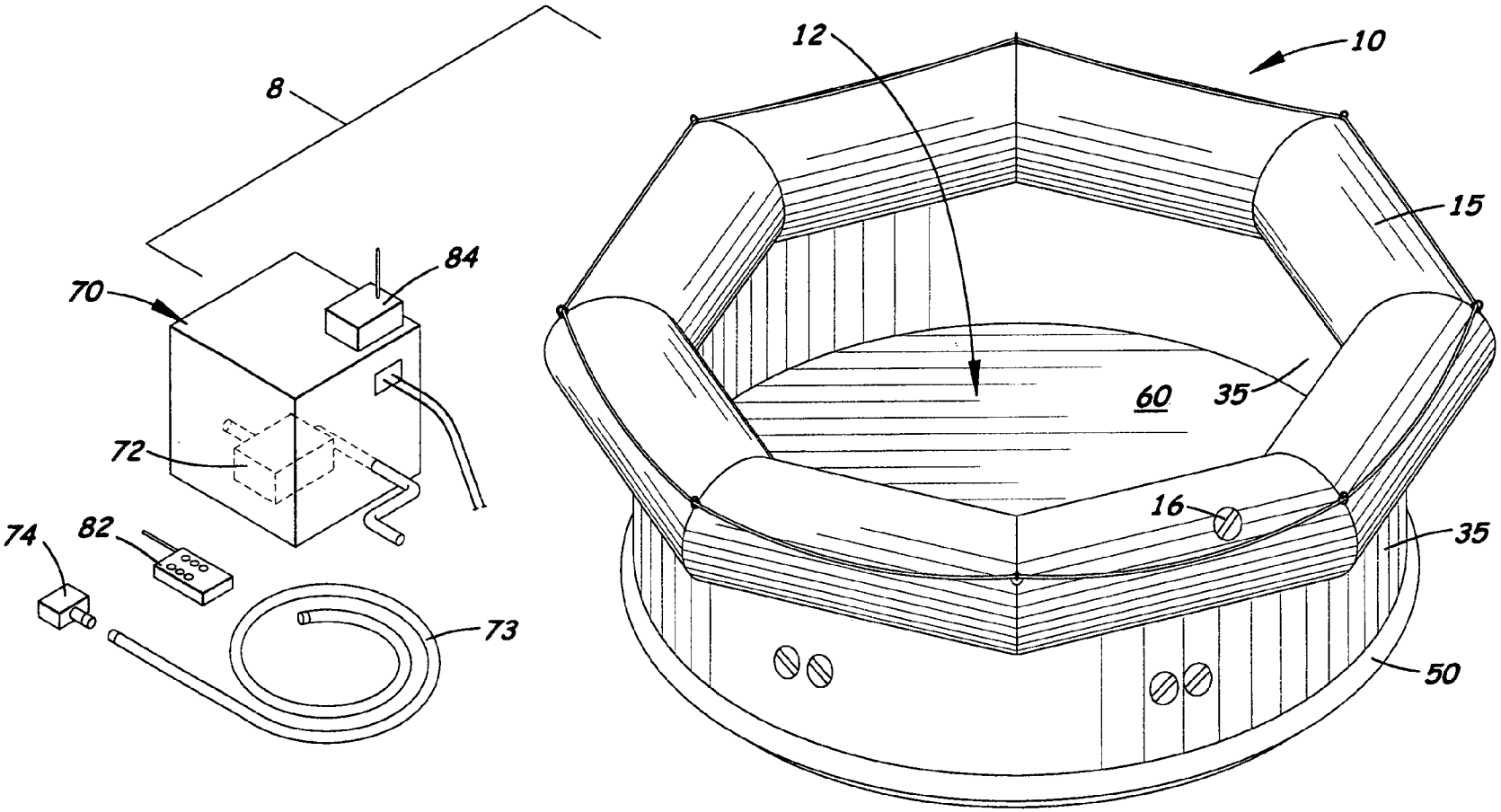
FIG. 2 is a top perspective view of the floated inflating hot tub.
Figure 3:
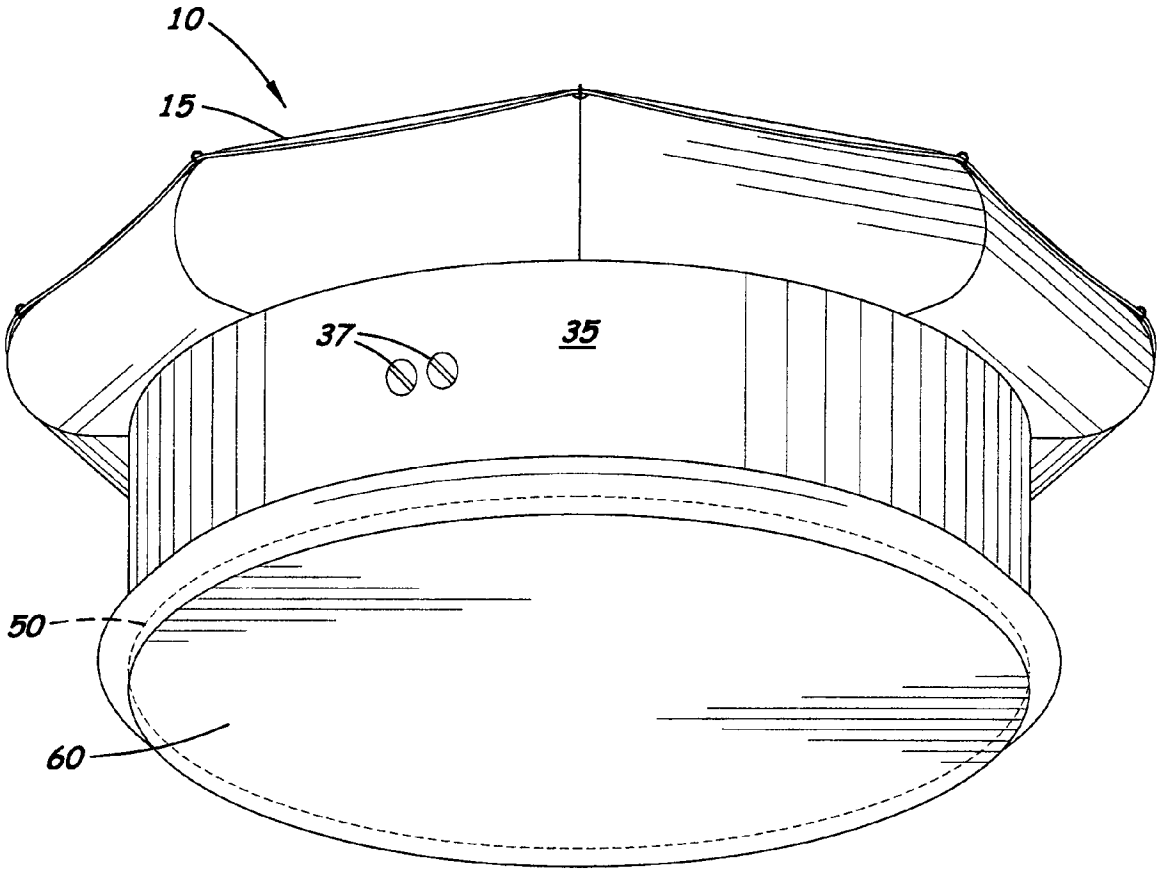
FIG. 3 is a bottom perspective of the invention shown in FIG. 2.
Figure 4:
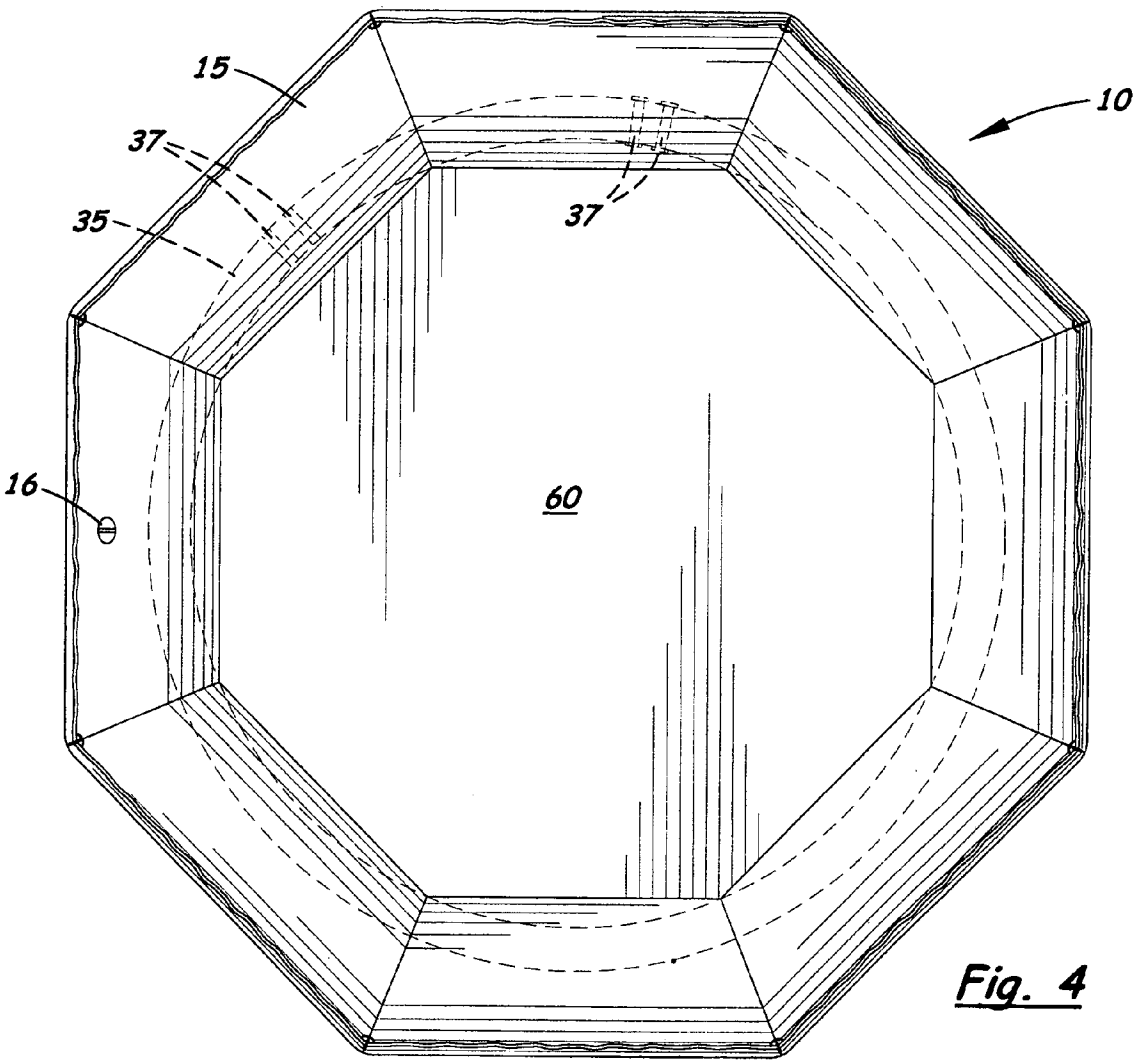
FIG. 4 is a top plan view of the invention.
Figure 5:
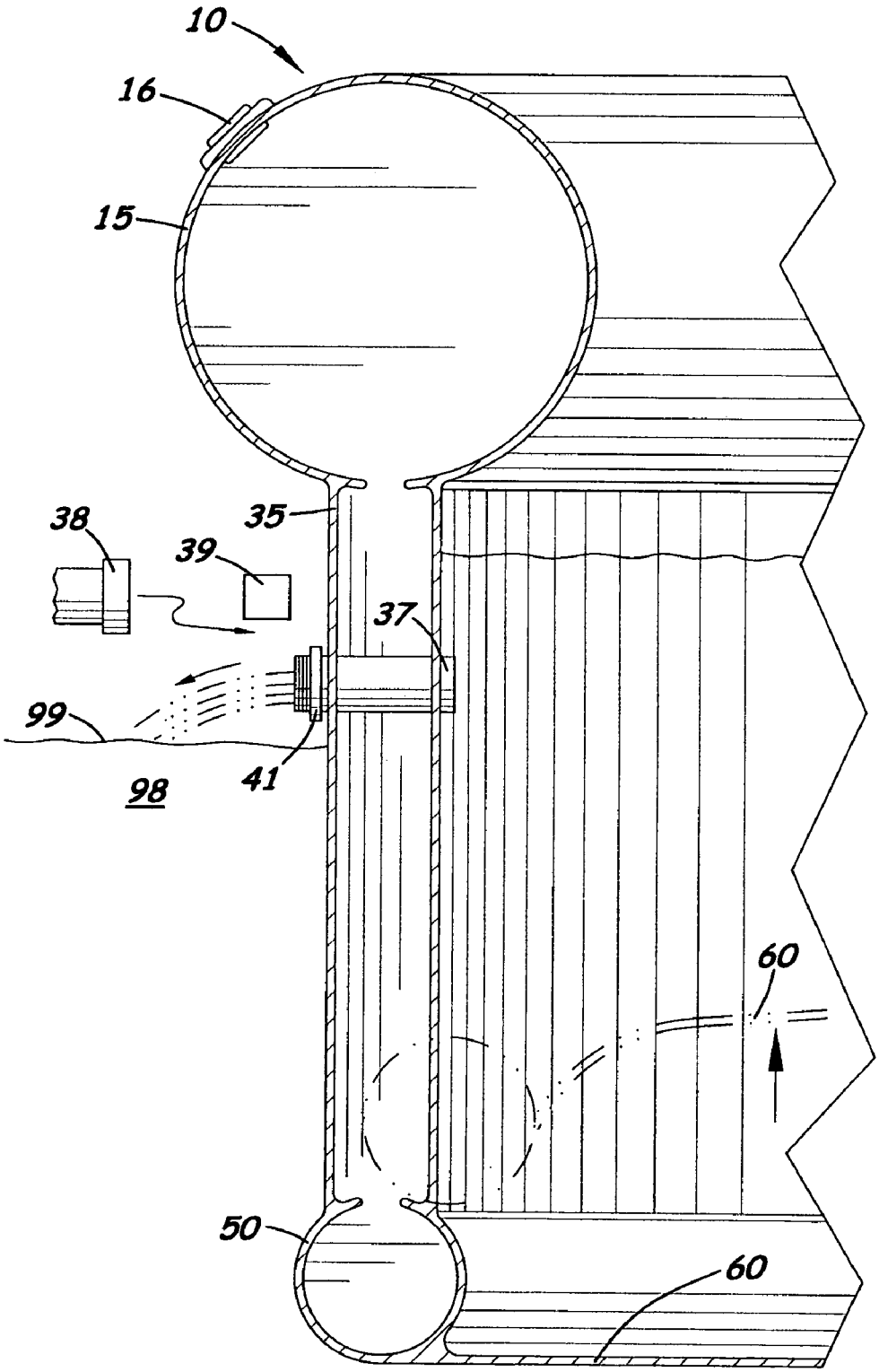
FIG. 5 is a sectional side elevational view of the tub structure.

There is shown in the accompanying FIGS. 1–5, an inflatable hot tub kit 8 designed to be placed in a body of water 98 adjacent to a boat 95 or on the ground (not shown). The kit 8 includes an inflatable tub structure 10 that comprises three stacked, inflatable ring sections 15, 35, 50 that form the upper edge, the sidewall, and lower edge, respectively, of the tub structure 10. Formed inside the tub structure 10 is an open center area 12 that is filled with warm or hot water 91 and used for soaking. In the preferred embodiment, the upper ring section 15 is octagonal-shaped when viewed inplan view and circular when viewed in cross-section. In the preferred embodiment, the upper ring section 15 is 10 to 18 inches in diameter and designed to operate like an inner tube to provide buoyancy, a protective barrier from outside waves, and a large pillow structure to provide comfort and to prevent water from splashing out of the tub structure 10. The upper ring section 15 also is designed to act as an insulating barrier to maintain heat of the warm or hot water 91. When the tub structure 10 is placed in a large body of water 98, the outside resting water level 99 is approximately 8 to 10 inches below the top surface of the upper ring section 15. Formed on the side of the upper ring section 15 is an air inlet port 18 designed to connect to a pump 65.

Vertically aligned and below the upper ring section 15 is an inflatable middle ring section 35. The middle ring section 35 is designed to provide buoyancy and form a relatively flat, curved sidewall on the tub structure 10 that supports the upper ring 15 when used on the ground. In the preferred embodiment, the middle ring section 35 is approximately 12 inches in height and 3 inches in thick. The middle ring structure 35 is vertically aligned under the center axis of the upper right section 15 to provide greater sitting area inside the tub structure 10.

Attached to the lower edge of the middle ring section 35 is a circular lower ring section 50 which also provides buoyancy, maintains the cylindrical shape of the tub structure 10, and supports the upper and middle ring sections 15, 35 when used on the ground. In the preferred embodiment, the lower ring structure 50 is circular in cross-section and approximately 3 inches in diameter.

Attached to the lower section 50 is a flat, non-inflatable, floor panel 60. The floor panel 60 is made of flexible material so that it flexes upward inside the open center area 12 of the tub structure 10 when the downward force on the floor panel is reduced. The downward force of the floor panel 60 is reduced when a user steps out of the tub structure 10 or when water from the main center area 12 is drained.

The ring sections 15, 35, and 50 are made of one or multiple layers of PVC material adhesively, mechanically sewn or heat welded together. The floor panel is approximately 3 inches thick and made of 'drop-stitch' fabric to provide floatation and insulation. The ring sections 15, 35, 50 are interconnected so that air passes freely therefrom. It should be understood that the ring sections 15, 35, 50 may be sealed cavities that are independently inflated with separate air inlet ports (not shown).

Formed near the lower edge of the middle ring section 35 is at least one drain port 37 that allows water to be added, re-circulated and drained from the open center area 12 of the tub structure 10. In the preferred embodiment, the drain ports 37 are 'tub-through' drain ports that extend through the middle ring section 35 and include one closeable cap 39. Each drain port 37 may include external or internal threads 41 or some other suitable hose fixture connection means that allows a standard hose 38 to selectively attach thereto. During use the ends of one or more supply hoses 38 may be attached to one or two of the three drain ports 37. The opposite ends of the supply hoses may be attached to the outlet ports on a hot water source and pump so that hot water may be continuously circulated in the tub structure 10. A third hose (not shown) may be attached to the return port on the hot water source or pump.

The drain ports 37 are positioned on the middle ring section 35 slightly above the outside water line so that water 98 located inside the tub structure 10 automatically and continuously flows outward from the main center area 12 when they are opened. When a user steps outside the tub and the drain port 37 is opened, the surrounding water under the tub presses the floor panel 60 upward which raises the water line in the main center area 12. As water is drained from the tub structure 10, the level of the inside water remains above the drain ports 37 thereby allow substantially all of the water to drain from the tub structure 10.

In the preferred embodiment, the tub structure 10 is approximately 44 inches in diameter and approximately 28 inches in height. It is designed to hold approximately 350 gallons of water with two adults sitting upright on the floor panel 60. When used in this matter, the height of the water inside the main center area 12 is approximately 8 inches below the top edge of the upper ring section 15.

The kit 8 also includes a master control unit 70 that connects to an external electrical system 97, water supply 96 and water heating system 98. The water supply system 96 may be a public utility water system, an RV's water system or a boat's water system. The water heating system 98 may be a home water heating system, an RV's heating system, or a boats water heating system. The master control unit 70 includes a water pump 72 to deliver water via a standard ½ or ⅝ inch diameter hose 73 to the tub structure 10, a solenoid check valve 73 to control the flow of water from the water supply 96 and into the tub structure 10, and an optional wireless transmitter 84 that connects to a remote, wireless receiver 82 operated by the user. It should be understood, that the solenoid check valve 73 may be connected to a water supply line from public water utility system on the dock (not shown). An optional thermostat 74 that during use is submerged into the tub water and coupled to the pump 72 and solenoid check valve 73 to automatically regulate the temperature of the water in the tub structure 10.

The kit 8 also includes at least one water hose 73 that connects at one end to the solenoid pump 72 and is inserted into the tube to deliver water to the tub structure 10. The kit 8 also includes an air delivery line 83 that extends from the air pump 80 to the air inlet port on the tub structure 10.

In compliance with the statute, the invention described herein has been described in language more or less specific as to structural features. It should be understood, however, that the invention is not limited to the specific features shown, since the means and construction shown is comprised only of the preferred embodiments for putting the invention into effect. The invention is therefore claimed in any of its forms or modifications within the legitimate and valid scope of the amended claims, appropriately interpreted in accordance with the doctrine of equivalents.

I claim:

1. An inflatable hot tub kit comprising:

a. a tub structure that includes three stacked, inflatable ring sections and a lower flexible panel that forms an open center area capable of being filled with heated water, said ring sections having sufficient buoyancy that enables said tub structure to float when placed in a body of water, said floor panel being sufficiently flexible to bow upward when downward force thereon is reduced thereby maintaining the water level inside said open center area when water therefrom is removed, said inflatable sections including an upper section being circular in cross-section, an inflatable middle ring section being polygonal in cross-section, and an inflatable lower ring section being integrally formed with said middle ring section;

b an air inlet/outlet port formed on said upper ring section of said tub structure;

c. a water drain formed on said middle ring section of said tub structure which is selectively closed or opened to allow water to fill or drain, respectively, from said open center area; and, d. a source of heated water capable of filling said open center area of said tub structure.

2. The inflatable hot tub, as recited in claim 1, wherein said upper ring section is circular in cross-section.

3. The inflatable hot tub, as recited in claim 2, wherein said upper ring section is approximately 12 inches in diameter.

4. The inflatable hot tub, as recited in claim 3, wherein said middle ring section is approximately 3 inches thick.

5. The inflatable hot tub, as recited in claim 4, wherein said middle ring section is approximately 20 inches in width.

6. The inflatable hot tub, as recited in claim 4, wherein said lower ring is approximately 3 inches in diameter.

7. The inflatable hot tub, as recited in claim 6, wherein said middle ring section and said lower ring section are vertically aligned below said upper ring section.

8. The inflatable hot tub, as recited in claim 7, wherein said tub structure holds approximately 320 gallons of water.

9. The inflatable hot tub, as recited in claim 3, wherein said middle ring section is approximately 20 inches in width.

10. The inflatable hot tub, as recited in claim 2, wherein said middle ring section is rectangular in cross-section.

11. The inflatable hot tub, as recited in claim 10, wherein said lower ring section is circular in cross-section.

12. The inflatable hot tub, as recited in claim 1, wherein said middle ring section is rectangular in cross-section.

13. The inflatable hot tub, as recited in claim 1, wherein said lower ring section is circular in cross-section.

14. The inflatable hot tub, as recited in claim 13, wherein said lower ring is approximately 3 inches in diameter.

15. The inflatable hot tub, as recited in claim 1, wherein said upper ring section, said middle ring section, and said lower ring section are made of PVC fabric.

16. The inflatable hot tub, as recited in claim 1, wherein said water drain includes a fixture capable of attaching to a hose thereby enabling water to be circulated in said center open area.

17. The inflatable hot tub, as recited in claim 1, wherein said floor panel is approximately 3 inches thick.

18. The inflatable hot tub, as recited in claim 17, wherein said floor panel is made of PVC.

19. The inflatable hot tub, as recited in claim 1, further including a master control unit that includes a water pump to deliver water via a hose to said inlet port, and a solenoid check valve to control the flow of water from a water supply to said inlet port.

20. The inflatable hot tub, as recited in claim 19, further including a wireless receiver coupled to said master control unit and a wireless transmitter controlled by a user to control the operation of said master control unit.

* * * * *